US009840845B2

(12) United States Patent
Kalkanoglu et al.

(10) Patent No.: US 9,840,845 B2
(45) Date of Patent: Dec. 12, 2017

(54) BUILDING PRODUCT INCLUDING A METAL CARBONATE AND A PROCESS OF FORMING THE SAME

(71) Applicants: Husnu M. Kalkanoglu, Swarthmore, PA (US); Gregory F. Jacobs, Oreland, PA (US)

(72) Inventors: Husnu M. Kalkanoglu, Swarthmore, PA (US); Gregory F. Jacobs, Oreland, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 784 days.

(21) Appl. No.: 14/023,141

(22) Filed: Sep. 10, 2013

(65) Prior Publication Data

US 2014/0079925 A1 Mar. 20, 2014

Related U.S. Application Data

(60) Provisional application No. 61/701,074, filed on Sep. 14, 2012.

(51) Int. Cl.
*E04D 1/22* (2006.01)
*E04D 1/28* (2006.01)
(Continued)

(52) U.S. Cl.
CPC ..... *E04D 1/22* (2013.01); *E04D 1/28* (2013.01); *E04F 13/0866* (2013.01);
(Continued)

(58) Field of Classification Search
CPC ..... E04D 1/28; E04D 1/22; E04F 13/0866; E04F 13/18; Y10T 428/249986;
(Continued)

(56) References Cited

U.S. PATENT DOCUMENTS 5,116,790 A 5/1992 Bruno et al.
5,298,654 A 3/1994 DeGuire et al.
(Continued)

OTHER PUBLICATIONS

University of Cadiz "Novel Calcium Silicate Gel and Procedure for CO2 and Other".
(Continued)

*Primary Examiner* — Brian Handville
(74) *Attorney, Agent, or Firm* — Abel Law Group, LLP; Alexander H. Plache

(57) ABSTRACT

A process of forming a building product can include providing a first layer having a first material, and providing a second layer having a second material that different from the first material, wherein the second layer has pores. The process can further include infiltrating a fluid into the pores of the second layer while the first layer is present and adjacent to the second layer, wherein the fluid includes a carbonate. The process can still further include reacting the carbonate with a metal compound within the second layer to form a metal carbonate within the second layer. In another aspect, a building product can include a first layer having a first material, and a second layer having a second material and a third material that includes a metal carbonate. The first material can be different from the second material, and the second and third materials can include the same metal element.

23 Claims, 4 Drawing Sheets

(51) Int. Cl.
*E04F 13/08* (2006.01)
*E04F 13/18* (2006.01)

(52) U.S. Cl.
CPC ..... *E04F 13/18* (2013.01); *Y10T 428/24942* (2015.01); *Y10T 428/249971* (2015.04); *Y10T 428/249981* (2015.04); *Y10T 428/249986* (2015.04); *Y10T 428/256* (2015.01)

(58) Field of Classification Search
CPC . Y10T 428/249981; Y10T 428/249971; Y10T 428/24942; Y10T 428/256
USPC ..... 428/212, 328, 316.6, 702, 313.3, 317.9; 427/399; 264/129
See application file for complete search history.

(56) References Cited

U.S. PATENT DOCUMENTS

| | | | | |
|---|---|---|---|---|
| 7,351,462 | B2 | 4/2008 | Friedman et al. | |
| 2004/0213705 | A1 | 10/2004 | Blencoe et al. | |
| 2006/0251807 | A1 | 11/2006 | Hong et al. | |
| 2009/0142578 | A1 | 6/2009 | Riman et al. | |
| 2009/0143211 | A1 | 6/2009 | Riman et al. | |
| 2011/0158873 | A1* | 6/2011 | Riman ..... | B01D 53/1425 423/228 |
| 2011/0165400 | A1 | 7/2011 | Quaghebeur et al. | |

OTHER PUBLICATIONS

"Carbonation of Calcium Silicates for Long-Term CO2 Sequestration" 2003.

* cited by examiner

BUILDING PRODUCT INCLUDING A METAL CARBONATE AND A PROCESS OF FORMING THE SAME

This application claims priority to and benefit of U.S. Provisional Patent Application No. 61/701,074, filed Sep. 14, 2012, which is incorporated herein by reference in its entirety.

FIELD OF THE DISCLOSURE

The present disclosure relates to building products and methods of forming building products, and more particularly to, building products including metal carbonates and processes of forming the same.

RELATED ART

Synthetic roofing shingle or tile can include a core material formed of generally less expensive material, and a skin material disposed on a plurality of surfaces of the shingle or tile. The skin material is generally more expensive and has weather-withstanding qualities. Further improvements in such shingles, tiles, and other building products are desired.

BRIEF DESCRIPTION OF THE DRAWINGS

Embodiments are illustrated by way of example and are not limited in the accompanying figures.

Figure 1:
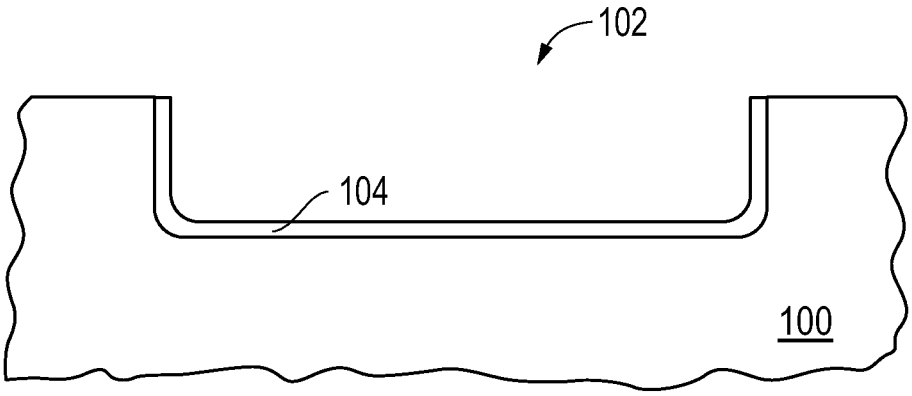
FIG. 1 includes an illustration of a cross-sectional view of a portion of a mould after forming an exterior layer of a partially-formed building product within a cavity of the mould.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Before addressing details of embodiments described below, some terms are defined or clarified. When referring to an average diameter distribution, "D" followed by a number refers to percentile of the distribution that is less than an average diameter. For example, D10 of 1 micron means that 10% of the particles have an average diameter of 1 micron or smaller.

Except for atmospheric pressure, all pressures described herein are gauge pressures unless explicitly stated otherwise.

The term "rare earth," within respect to the elements of the Period Table of the Elements, is intended to mean Sc, Y, La, and the lanthanide series.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the roofing product arts and corresponding manufacturing arts.

A building product can include a first layer having a first material and a second layer having a second material and a third material that includes a metal carbonate. The first material can be different from the second material, and the second and third materials can include the same metal element. The first layer can be an exterior layer that is normally visible to humans, and the second layer can be an interior layer that is not normally visible to humans once the building product is installed. When forming the building product, the first and second layer can be formed and a fluid can infiltrate into pores of the second layer and react with the second material to form the third material.

The building product can be used in a variety of applications within a building. The building product may be a roofing product, cladding, a framing member, or another suitable application in which the building product is exposed to the outdoors. In another embodiment, the building product may be used along a wall, floor, or ceiling, or another suitable interior application.

The building product may be formed by a green process, that is, one in which atmospheric $CO_2$ or another greenhouse gas can be captured to form carbonic acid or a carbonate form, and thus, the process can be used to reduce $CO_2$ in the atmosphere and form a stable metal carbonate that is not readily converted back to $CO_2$ in normal use of the building product. Additional benefits can include using a less expensive or less visibly appealing material for the second layer and convert it to a compound that is more weather resistant, durable, has another desirable property, or any combination thereof. Additionally, a low density filler material or void containing filler material can be included in one or more layers to moderate the density of the building product.

Exemplary processes and products are illustrated in the figures and described below. The particular embodiments are merely illustrative and are not intended to limit the scope of the claims. After reading the specification, skilled artisans will appreciate that other embodiments not described herein can be used without departing from the scope of the invention.

In a particular embodiment, a process can use a mould to assist in forming the building product. FIG. 1 includes a cross-sectional view of a portion of a mould 100 that includes a cavity 102. The shape of the cavity 102 can correspond to the shape of the building product that is being formed. The surface of the mould 100 along the cavity 102 can have a smooth surface, a matte surface, a feature, or any combination thereof. An exterior surface of the building product being formed will have a relief feature, a cosmetic feature, another suitable feature, or any combination thereof. An exterior layer 104 is formed along the exposed surfaces of the cavity 102. In a particular embodiment, the exterior layer 104 will be visible to humans when the building product is installed. If a feature is present within the cavity, the exterior layer 104 may completely cover or only partly cover the feature within the cavity 102. The significance of completely or only partly covering the feature is described in more detail after formation of the building product is completed. The exterior layer 104 only partly fills and does not completely fill the cavity 102.

The exterior layer 104 may be applied as a coating, a paste, pressed into place, or using another technique. If needed or desired, volatile or organic components within the exterior layer 104 may be driven off or otherwise removed before forming another layer within the cavity 102.

Figure 2:
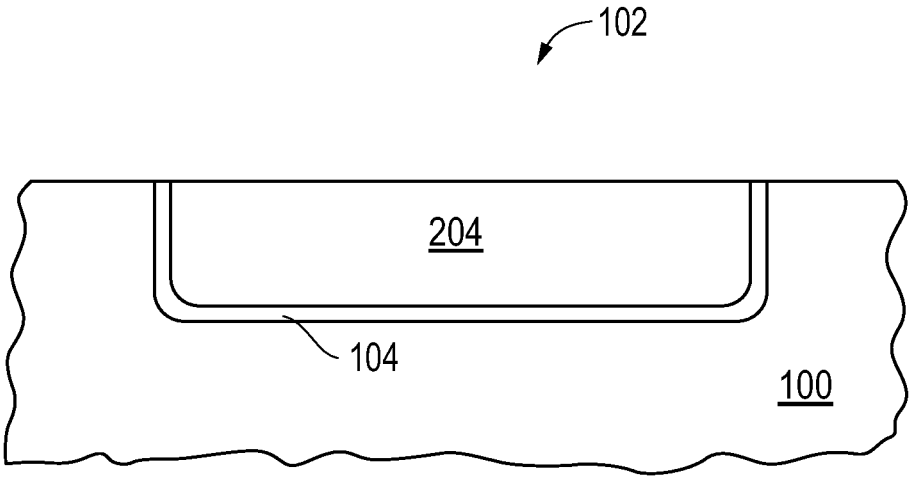
FIG. 2 includes an illustration of a cross-sectional view of the mould and exterior layer after forming an interior layer within the cavity of the mould.

FIG. 2 includes an illustration after an interior layer 204 (also referred to as the unreacted interior layer 204) is formed within the cavity 102. In the embodiment as illustrated, the interior layer 204 completely fills a remaining portion of the cavity 102. In another embodiment, the interior layer 204 may only partly fill and not completely fill the remaining portion of the cavity 102. The interior layer 204 can be applied using any of the techniques as described with respect to the exterior layer 104. In an embodiment, the interior layer 204 can be formed by using a solid material and compressing the solid material into the cavity 102. In a particular embodiment, vibratory compaction can be used.

A volume occupied by the interior layer 204 may be larger than a volume occupied by the exterior layer 104. In an embodiment, a ratio of the volume of the interior layer 204 to the volume of the exterior layer 104 occupies a volume that is at least approximately 1.1:1, at least approximately 1.5:1, at least approximately 2:1, at least approximately 3:1, at least approximately 5:1, or at least approximately 9:1.

On a comparative basis, the exterior layer 104 and the interior layer 204 are different from one another. The layers 104 and 204 can have the substantially the same composition but different open porosities or different average diameters. In another embodiment, layers 104 and 204 have different compositions. A material within the interior layer 204 will react with a carbonate to form a metal carbonate. The carbonate may or may not react with a material within the exterior layer 104. In a further embodiment, the layers 104 and 204 may have different compositions, different porosities, different average diameters, or any combination thereof. Exemplary materials within the interior layer 204 will be described before describing materials for the exterior layer 104.

The interior layer 204 may include a matrix and corresponding pores. Exemplary materials can include a metal oxide, a metal hydroxide, a metal sulfate, a metal silicate, a metal halide, another suitable metal compound, or any combination thereof. Each of the metal compounds can be a single metal element compound or a mixed-metal compound.

An exemplary metal oxide can include beryllium (for example, BeO), magnesium (for example, MgO), calcium (for example, CaO or $CaO_2$), strontium (for example, SrO), barium (for example, BaO), scandium (for example, $Sc_2O_3$), yttrium (for example, $Y_2O_3$), lanthanum (for example, $La_2O_3$), neodymium (for example, $Nd_2O_3$), any of the other lanthanide series oxides, any of the other actinide series oxides, titanium (for example, TiO, $TiO_2$, or $Ti_2O_3$), zirconium (for example, $ZrO_2$), hafnium (for example, $HfO_2$), vanadium (for example, VO, $V_2O_3$, $VO_2$, or $V_2O_5$), niobium (for example, $NbO_2$ or $Nb_2O_5$), tantalum (for example, $TaO_2$ or $Ta_2O_5$), chromium (for example, CrO, $Cr_2O_3$, $CrO_3$, or $CrO_2$), molybdenum (for example, $MoO_2$, $Mo_2O_5$, $Mo_2O_3$ or $MoO_3$), tungsten (for example, $WO_2$ or $W_2O_5$), manganese (for example, MnO, $Mn_2O_3$, $MnO_2$, or $Mn_2O_7$), technetium (for example, $Tc_2O$ or $Tc_2O_3$), rhenium (for example, $ReO_2$ or $Re_2O_3$), iron (for example, FeO or $Fe_2O_3$), cobalt (for example, CoO, $Co_2O_3$, or $Co_3O_4$), nickel (for example, NiO or $Ni_2O_3$), ruthenium (for example, $RuO_2$ or $RuO_4$), rhodium (for example, $RhO_2$ or $Rh_2O_3$), palladium (for example, PdO or $PdO_2$), osmium (for example, OsO or $OsO_2$), iridium (for example, $IrO_2$ or $IR_2O_3$), platinum (for example, PtO, $PtO_2$, $PtO_3$, $Pt_2O_3$, or $Pt_3O_4$), copper (for example, CuO, $Cu_2O$), silver (for example, $Ag_2O$), gold (for example, $Au_2O_3$ or $Au_2O$), zinc (for example, ZnO), aluminum (for example, $Al_2O_3$), gallium (for example, $Ga_2O_3$ or $Ga_2O$), indium (for example, $In_2O_3$), germanium (for example, GeO, $GeO_2$), tin (for example, SnO, $SnO_2$), lead (for example, PbO, $PbO_2$, $Pb_3O_4$, $Pb_2O_3$, or $Pb_2O$), antimony (for example, $Sb_2O_3$ or $Sb._2O_5$), bismuth (for example, $Bi_2O_3$, $Bi_2O_5$, $Bi_2O_4$, $Bi_2O_3$, or BiO), a magnesium titanate (for example, $MgTiO_3$), a calcium titanate (for example, $CaTiO_3$), a strontium titanate (for example, $SrTiO_3$), a barium titanate (for example, $BaTiO_3$), a doped or partially substituted oxide (for example, $Ca_xSr_{(1-x)}TiO_3$ or $BaTi_yLa_{(1-y)}O_3$), another suitable metal oxide capable of forming a metal carbonate or any combination thereof.

In another embodiment, the metal hydroxide can include a magnesium hydroxide (for example, $Mg(OH)_2$), a calcium hydroxide (for example, $Ca(OH)_2$), a strontium hydroxide (for example, $Sr(OH)_2$), a barium hydroxide (for example, $Ba(OH)_2$), a titanium hydroxide (for example, $Ti(OH)_2$), a zirconium hydroxide (for example, $Zr(OH)_4$), a chromium hydroxide (for example, $Cr(OH)_2$), a manganese hydroxide (for example, $Mn(OH)_2$), an iron hydroxide (for example, $Fe(OH)_2$), a copper hydroxide (for example, $Cu(OH)_2$), a zinc hydroxide (for example, $Zn(OH)_2$), an aluminum hydroxide (for example, $Al(OH)_3$), or any combination thereof.

The metal sulfate can include $MgSO_4$, $CaSO_4$, $SrSO_4$, $BaSO_4$, a titanium sulfate (for example, $TiSO_4$ or $Ti_2(SO_4)_3$), $ZrSO_4$), a chromium sulfate (for example, $Cr_2(SO_4)_3$), a manganese sulfate (for example, $MnSO_4$), an iron sulfate (for example, $FeSO_4$), a nickel sulfate (for example, $NiSO_4$), a copper sulfate (for example, $CuSO_4$), $ZnSO_4$), $Al_2(SO_4)_3$), another suitable metal sulfate capable of forming a metal carbonate, or any combination thereof.

The metal silicate can include a lithium metasilicate, a lithium orthosilicate, a sodium metasilicate, a beryllium silicate, a calcium silicate, a strontium orthosilicate, a barium metasilicate, a zirconium silicate, a manganese metasilicate, an iron silicate, a cobalt orthosilicate, a zinc orthosilicate, a cadmium metasilicate, a mullite, a rare earth oxyorthosilicate, a rare earth pyrosilicate, andalusite, silimanite, hyanite, kaolinite, or any combination thereof.

The metal halide can be a metal fluoride including $MgF_2$, $CaF_2$, $SrF_2$, $BaF_2$, a titanium fluoride (for example, $TiF_3$), a zirconium fluoride (for example, $ZrF_4$), a chromium fluoride (for example, $CrF_2$), a manganese fluoride (for example, $MnF_2$), an iron fluoride (for example, $FeF_2$), a copper fluoride (for example, $CuF_2$), a nickel fluoride (for example, $NiF_2$), $ZnF_2$, $AlF_3$), a mixed-metal halide (for example, $La_xCe_{(1-x)}Br_3$ or $Lu_yCe_{(1-y)}Cl_3$), another suitable metal halide capable of reacting to form a metal carbonate, or any combination thereof. Alternatively, the anion of the metal salts may come, for example, from the following groups: hydroxides, nitrates, chlorides, acetates, formates, propionates, phenylacetates, benzoates, hydroxybenzoates, aminobenzoates, methoxybenzoates, nitrobenzoates, sulfates, fluorides, bromides, iodides, carbonates, oxalate, phosphate, citrate, and silicates, or mixtures thereof.

The exterior layer 104 can include any of the materials as described with respect to the interior layer 204. Further, the exterior layer 204 can include pigments, colorants, antimicrobials, photocatalysts or other components to modify the appearance and aesthetics of the exterior layer or its functionality.

The exterior layer 104, the interior layer 204, or both may include a low density filler material or void containing filler material to moderate the density of the building product. Examples of such materials can include hollow glass microspheres, hollow ceramic microspheres, polymer microspheres, expanded perlite, volcanic ash, pumice, another suitable material, or any combination thereof. Such materials may or may not participate in the carbonation reaction described herein.

A material within the exterior layer 104 can have an average diameter, and a material within the interior layer 204 can a different average diameter. The average diameter of the material within the exterior layer 104 is no greater than approximately 95%, no greater than approximately 90%, no greater than approximately 80%, no greater than approximately 70%, no greater than approximately 50%, or no greater than approximately 20% of the average diameter of the material within the interior layer 204.

In an embodiment, the material of the interior layer 204 has a D10 average diameter of at least approximately 0.001 microns, at least approximately 0.015 microns, at least approximately 0.11 microns, or at least approximately 1 micron, and in another embodiment, the D10 average diameter is no greater than approximately 300 microns, no greater than approximately 9 microns, no greater than approximately 0.7 microns, or no greater than approximately 0.01 microns. In an embodiment, the material of the interior layer 204 has a D50 average diameter of at least approximately 0.1 microns, at least approximately 0.7 microns, at least approximately 3 microns, or at least approximately 10 microns, and in another embodiment, the D50 average diameter is no greater than approximately 500 microns, no greater than approximately 60 microns, no greater than approximately 11 microns, or no greater than approximately 5 microns. In a further embodiment, the material of the interior layer 204 has a D90 average diameter of at least approximately 1 micron, at least approximately 9 microns, at least approximately 21 microns, or at least approximately 50 microns, and in another embodiment, the D90 average diameter is no greater than approximately 700 microns, no greater than approximately 300 microns, no greater than approximately 125 microns, or no greater than approximately 50 microns. In another embodiment, In an embodiment, the material of the exterior layer 104 has a D10 average diameter of at least approximately 0.001 microns, at least approximately 0.003 microns, at least approximately 0.007 microns, or at least approximately 0.01 microns, and in another embodiment, the D10 average diameter is no greater than approximately 30 microns, no greater than approximately 8 microns, no greater than approximately 0.2 microns, or no greater than approximately 0.01 microns. In an embodiment, the material of the exterior layer 104 has a D50 average diameter of at least approximately 0.1 microns, at least approximately 0.8 microns, at least approximately 1.3 microns, or at least approximately 2 microns, and in another embodiment, the D50 average diameter is no greater than approximately 200 microns, no greater than approximately 21 microns, no greater than approximately 7 microns, or no greater than approximately 0.7 microns. In a further embodiment, the material of the exterior layer 104 has a D90 average diameter of at least approximately 1 micron, at least approximately 8 microns, at least approximately 19 microns, or at least approximately 30 microns, and in another embodiment, the D90 average diameter is no greater than approximately 500 microns, no greater than approximately 220 microns, no greater than approximately 110 microns, or no greater than approximately 30 microns.

In an embodiment, the exterior layer 104 has a smaller amount of open porosity as compared to the interior layer 204. In a particular embodiment, the exterior layer 104 has an open porosity that is no greater than approximately 95%, no greater than approximately 90%, no greater than approximately 80%, no greater than approximately 70%, no greater than approximately 50%, or no greater than approximately 20% of an open porosity of the interior layer 204.

In an embodiment, the interior layer 204 has an open porosity that is at least approximately 11%, at least approximately 20%, at least approximately 30%, at least approximately 50%, or at least approximately 70% of an open porosity of the exterior layer 104. In another embodiment, the interior layer 204 has an open porosity that is at least approximately 5%, at least approximately 12%, at least approximately 17%, or at least approximately 25%, and in another embodiment, the interior layer 204 has an open porosity no greater than approximately 30%, no greater than approximately 23%, no greater than approximately 19%, or no greater than approximately 15%. In a further embodiment, the exterior layer 104 has an open porosity that is at least approximately 3%, at least approximately 7%, at least approximately 10%, or at least approximately 12%, and in another embodiment, the exterior layer 104 has an open porosity no greater than approximately 15%, no greater than approximately 12%, no greater than approximately 10%, or no greater than approximately 8%. In another embodiment, the interior layer 204 has a pore size that is at least about 0.01 microns, at least about 0.1 microns, or at least about 0.5 microns, and in another embodiment, no greater than about 100 microns, no greater than about 20 microns, or no greater than about 1 micron.

The process can continue with infiltrating a fluid into the pores of the interior layer 204 while the exterior layer 104 is present and adjacent to the interior layer 204. Pores within the interior layer 204 can allow the fluid to provide a reactant to a material within the interior layer 204. The reactant can be a carbonate of Na, K, Rb, Cs, Be, Mg, Ca, Sr, Ba, Sc, Y, La, Nd, Yb, or another lanthanide series element, Th or another actinide series element, Ti, Zr, Hf, V, Nb, Ta, Mo, W, Mn, Tc, Re, Fe, Co, Ni, Ru, Rh, Pd, Os, Ir, Pt, Cu, Ag, Au, Zn, Al, Ga, Ge, Sn, Sb, or any mixture thereof. In a further embodiment, the carbonate can be supplied as a carbonic acid.

The fluid may be a liquid or a gas. Skilled artisans may find use of a liquid, at the subsequent reaction conditions, to be particularly advantageous. In an embodiment, the liquid can include water, ammonia, an organic compound, another suitable medium for providing a reactant to the material of the interior layer 204, or any combination thereof. The organic compound can include an alcohol (for example, $C_xH_{(2x+1)}OH$, wherein x is 1, 2, or 3); a polyol (for example, $C_xH_{2x}(OH)_2$, wherein x is 1, 2, or 3); a heteroaromatic (for example, a furan, a thiophene, a pyrrole, or a pyridine); an amine (for example, $CH_3(CH_2)_nNH_2$, wherein n is 0, 1, or 2)); an ether, an ester, or a ketone having no more than 6 carbon atoms (for example, diethyl ether or acetone); a sulfoxides (for example, dimethylsulfoxide); an acetonitrile; another suitable organic compound; or any combination thereof. When an organic compound is used, skilled artisans may find such compounds that are relatively soluble in water to be particularly advantageous. In the organic compounds listed above, one or more H atoms may be substituted with one or more halides.

The pH of the fluid may be adjusted using an acid or a base. The acid can include an inorganic acid (for example, $H_2SO_4$, HCl, or $HNO_3$) or an organic acid (for example, citric acid, acetic acid, or oxalic acid). The pH of the fluid can be greater than 7, 8, 9, 19, 11, or 12. The base can include an inorganic base (for example, NaOH, KOH, or $NH_4OH$) or an organic base (for example, $CH_3(CH_2)_nNH_2$ or $((CH_3(CH_2)_n)_xNH_{(4-x)}OH$, wherein n is 0, 1, or 2, and x is 1, 2, 3, or 4). For the organic acids and bases, one or more H atoms may be substituted with a halide. In a further embodiment, a surfactant, a buffer, a corrosion inhibitor, or another suitable compound may be used to achieve a desired characteristic or reduce an adverse effect, or any combination thereof can be used.

Figure 3:
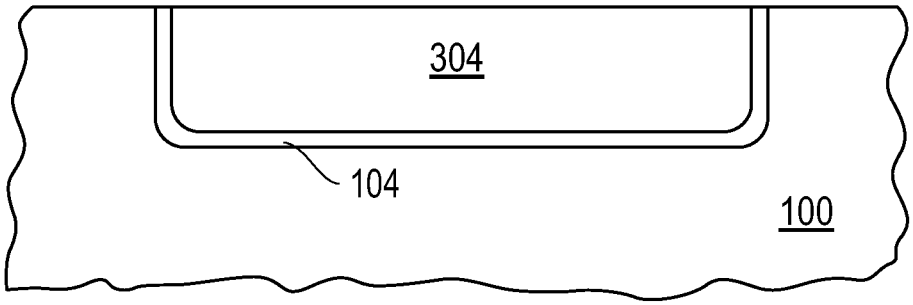
FIG. 3 includes an illustration of a cross-sectional view of the mould and exterior layer after reacting the interior layer to form a metal carbonate in accordance with an embodiment.

The process can further include reacting the carbonate with a material within the interior layer 204 to form a carbonate compound within the reacted interior layer 304, as illustrated in FIG. 3. In an embodiment, the material is a metal compound, and the reaction forms a metal carbonate.

The processing conditions for the reaction may take place at a variety of pressures, temperatures and time periods. In an embodiment, the reaction is performed at a pressure of at least approximately 5 kPa, at least approximately 11 kPa, at least approximately 50 kPa, at least approximately 110 kPa, at least approximately 500 kPa, at least approximately 1.1 MPa, at least approximately 5 MPa, at least approximately 11 MPa, or at least approximately 50 MPa. In another embodiment, the reaction is performed at a pressure no greater than approximately 900 MPa, no greater than approximately 500 MPa, no greater than least approximately 90 MPa, or no greater than approximately 50 MPa, no greater than approximately 900 kPa, no greater than approximately 500 kPa, no greater than approximately 90 kPa, or no greater than approximately 50 kPa. In one embodiment, the reaction is performed at substantially ambient pressure.

In an embodiment, the reaction is performed at a temperature of at least approximately 20° C., at least approximately 50° C., at least approximately 80° C., at least approximately 110° C., at least approximately 150° C., at least approximately 200° C., at least approximately 250° C., or at least approximately 300° C. In another embodiment, the reaction is performed at a temperature no greater than approximately 1000° C., no greater than approximately 500° C., no greater than approximately 300° C., no greater than approximately 250° C., no greater than approximately 190° C., no greater than approximately 150° C., no greater than approximately 130° C., no greater than approximately 100° C., or no greater than approximately 90° C. In one embodiment, the reaction is performed at substantially ambient temperature.

In an embodiment, the reaction is performed for a time period of at least approximately 11 seconds, at least approximately 1.1 minutes, at least approximately 5 minutes, at least approximately 11 minutes, at least approximately 20 minutes, at least approximately 1 hour, at least approximately 11 hours, at least approximately 20 hours, at least approximately 50 hours. In another embodiment, the reaction is performed for a time period no greater than approximately 200 hours, no greater than approximately 90 hours, no greater than approximately 24 hours, no greater than approximately 5 hours, no greater than approximately 3 hours, no greater than approximately 2 hours, no greater than approximately 0.9 hour, or no greater than approximately 0.5 hour.

The reaction may be performed in an autoclave, a pressure pot, or another suitable apparatus capable of achieving the needed or desired processing conditions. After the reaction is completed, the combination of the exterior layer 104 and reacted interior layer 304 are removed from the mould 100, and is illustrated as a building product 400 in FIG. 4. In the embodiment as illustrated, substantially all of the interior layer 204 is reacted to form the reacted interior layer 304. When the building product 400 has a relief feature (not illustrated) along the exposed surface of the exterior layer 102, the relief feature may affect only the exterior layer, or may extend to the reacted interior layer 304.

While many materials, infiltrating fluids, reactant compounds, and processing conditions have been described, after reading this specification, skilled artisans will be able to determine one or more particular materials, infiltrating fluids, reactant compounds, and processing conditions that are particularly well suited for an application. A metal oxide can react with an infiltrating fluid including carbonic acid to form a metal carbonate. In an illustrative example:

$$CaO+H_2CO_3 \rightarrow CaCO_3+H_2O$$

Alternatively, the material within the interior layer 204 can include a Group 2 or transition metal oxide, and the infiltrating solution can include a Group 1 metal carbonate that is dissolved in water or another aqueous solution. The carbonate anion can react with the Group 2 or transition metal oxide to form a Group 2 or transition metal carbonate. The reaction may be performed in a base to help hydrolyze the Group 2 or transition metal oxide before reacting with the carbonate anions. In a particular illustrative example:

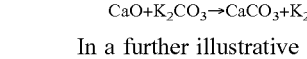

$$CaO+2KOH \rightarrow Ca(OH)_2+K_2O$$

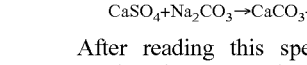

$$Ca(OH)_2+K_2CO_3 \rightarrow CaCO_3+2KOH$$

Thus, the overall reaction is:

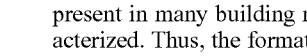

$$CaO+K_2CO_3 \rightarrow CaCO_3+K_2O$$

In a further illustrative example:

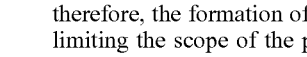

$$CaSO_4+Na_2CO_3 \rightarrow CaCO_3+Na_2SO_4$$

After reading this specification, skilled artisans will appreciate that many other reactions may be used. $CaCO_3$ is present in many building materials and is extensively characterized. Thus, the formation of $CaCO_3$ may be desired. In other applications, other materials may be desired, and therefore, the formation of $CaCO_3$ is not to be construed as limiting the scope of the present invention.

Analogous carbonates can also be employed using barium or magnesium salts or other divalent metal cation salts to yield, for example, barium or magnesium carbonates. Alternatively, mixtures of cation metals may be included to produce mixed metal carbonates comprising one or more of calcium, magnesium, or barium, copper, iron, manganese, nickel, silver, or zinc. In certain embodiments, the solubility of the metal carbonate in water at 20° C. is less than about 0.05, less than about 0.004, less than about 0.001, or less than about 0.0008 grams per 100 grams of water.

The reaction can change the characteristics of the reacted interior layer 304 as compared to the unreacted interior layer 204 or the exterior layer 104. Such characteristics can include open porosity, average diameter, or change in volume occupied when forming the building product.

The open porosity of the reacted interior layer 304 may be less than the open porosity of the unreacted interior layer 204. In an embodiment, the open porosity of the reacted interior layer 304 is no greater than approximately 99%, no greater than approximately 95%, no greater than approximately 90%, no greater than approximately 80%, or no greater than approximately 70% of the open porosity of the unreacted interior layer 204. In another embodiment, the reacted interior layer 304 has an open porosity of at least approximately 4%, at least approximately 11%, at least approximately 15%, or at least approximately 18%, and in another embodiment, the reacted interior layer 304 has an open porosity no greater than approximately 29%, no greater than approximately 22%, no greater than approximately 18%, or no greater than approximately 15%. The open porosity of the exterior layer 104 may still be less than the open porosity of the reacted interior layer 304. In a particular embodiment, the exterior layer 104 has the open porosity that is at least approximately 11%, at least approximately 20%, at least approximately 30%, at least approximately 50%, or at least approximately 70% of an open porosity of the reacted interior layer 304.

The average diameter of a material within the reacted interior layer 304 may be changed as compared to the corresponding unreacted material from the interior layer 204. In an embodiment, the material within the reacted interior layer 304 has a D10 average diameter that is at least approximately 0.002 microns, at least approximately 0.02 microns, at least approximately 0.2 microns, or at least approximately 1 micron, and in another embodiment, the D10 average diameter no greater than approximately 400 microns, no greater than approximately 15 microns, no greater than approximately 1.2 microns, or no greater than approximately 0.05 microns. In an embodiment, the material within the reacted interior layer 304 has a D50 average diameter that is at least approximately 0.15 microns, at least approximately 1.2 microns, at least approximately 5 microns, or at least approximately 12 microns, and in another embodiment, the D50 average diameter no greater than approximately 600 microns, no greater than approximately 80 microns, no greater than approximately 14 microns, or no greater than approximately 7 microns. In an embodiment, the material within the reacted interior layer 304 has a D90 average diameter that is at least approximately 3 microns, at least approximately 12 microns, at least approximately 26 microns, or at least approximately 60 microns, and in another embodiment, the D90 average diameter no greater than approximately 750 microns, no greater than approximately 350 microns, no greater than approximately 140 microns, or no greater than approximately 60 microns.

Figure 4:
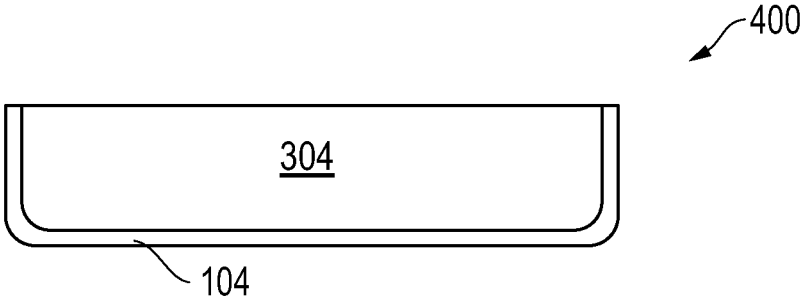
FIG. 4 includes an illustration of a cross-sectional view of a substantially completed building product after removing the building product from the mould.

Ideally, a volume occupied by the building product before the reaction (that is, the volume occupied by a combination of the exterior layer 104 and the unreacted interior layer 204 for the embodiment illustrated in FIG. 2), also referred to as the pre-reaction volume, is substantially the same as the volume occupied by the building product 400 after the reaction (that is, the volume occupied by a combination of the exterior layer 104 and the reacted interior layer 304 for the embodiment illustrated in FIG. 4), also referred to as the post-reaction volume. In actual practice, the volume may change such that the post-reaction volume is greater than or less than the pre-reaction volume. In an embodiment, the post-reaction volume of the building product 400 is within approximately 30%, within approximately 20%, within approximately 15%, within approximately 9%, within approximately 5%, or within approximately 2% of the pre-reaction volume of the building product.

Similar to the building product, ideally, a volume occupied by the unreacted interior layer 204 is substantially the same as the volume occupied by the volume occupied by the reacted interior layer 304. In actual practice, the volume may change such that the volume of the reacted interior layer 304 is greater than or less than the volume of the unreacted interior layer 204. In an embodiment, the volume of the reacted interior layer 304 is within approximately 30%, within approximately 20%, within approximately 15%, within approximately 9%, within approximately 5%, or within approximately 2% of the volume of the unreacted interior layer 204.

Figure 5:
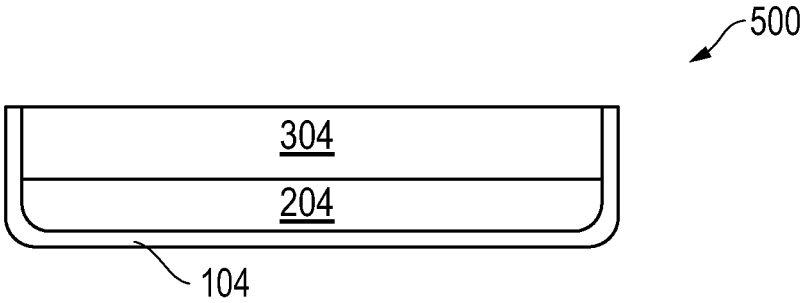
FIG. 5 includes an illustration of a cross-sectional view of a substantially completed building product in accordance with another embodiment.

In another embodiment, not all of the material within the interior layer 204 may react. As illustrated in FIG. 5, a building product 500 includes the exterior layer 104, an unreacted portion of the interior layer 204, and the reacted interior layer 304. At least 0.0001% of the interior layer 204 may be reacted. In this particular embodiment, the thickness of the reacted interior layer 304 may provide sufficient protection to the building product 500 for conditions under which the building product 500 will normally be exposed. The unreacted interior layer 204 can have a density less as compared to the reacted interior layer 304, and therefore, the mass of the building product 500 can be reduced by not reacting all of the interior layer 204. The building product 500 may be used in an application where it is not located along a surface that is supposed to support a load, such as wall or ceiling panels, wall cladding or a framing member adjacent to a window or door. In an embodiment, no more than approximately 50%, no more than approximately 40%, no more than approximately 30%, no more than approximately 20%, or no more than approximately 9% of the interior layer 204 is reacted.

In another application, the building product may need to support a load in its normal use. For example, floor tiles may need to support humans or furniture, and roofing tiles may need to occasionally support humans during installation or maintenance of a roof. Thus, more of the interior layer 204 may need to be reacted. In an embodiment, at least approximately 50%, at least approximately 70%, at least approximately 80%, at least approximately 90%, or at least approximately 95% of the interior layer 204 is reacted. In a particular embodiment, at least approximately 99% or substantially all of the interior layer 204 is reacted.

Figure 6:
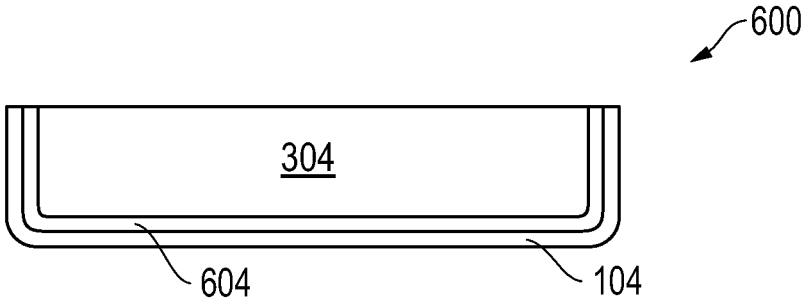
FIG. 6 includes an illustration of a cross-sectional view of a substantially completed building product in accordance with a further embodiment.

In a further embodiment, the infiltrant can reach the exterior layer 104 and react with a portion of the exterior layer 104 to form an intermediate layer 604 between the reacted interior layer 304 and the exterior layer 104, as illustrated in FIG. 6. The intermediate layer 604 may extend partly, but not completely, through the exterior layer 104. In an embodiment, the intermediate layer 604 can extend to an interface penetration distance from an interface with the reacted interior layer 304. In an embodiment, the interface penetration distance extends at least approximately 10%, at least approximately 20%, at least approximately 30%, at least approximately 40%, at least approximately 50%, at least approximately 60%, at least approximately 70%, at least approximately 80%, or at least approximately 90% of the distance from the interface to an outer surface of the exterior layer 104, when compared to the originally formed exterior layer 104 (before the reaction). In an embodiment, the interface penetration distance extends at least approximately 0.011 mm, at least approximately 0.05 mm, at least approximately 0.11 mm, at least approximately 0.5 mm, at least approximately 1.1 mm, or at least approximately 5 mm of the distance from the interface with the interior layer 304, and in another embodiment, the interface penetration distance extends no greater than approximately 11 mm, no greater than approximately 7 mm, no greater than approximately 4 mm, no greater than approximately 2 mm, no greater than approximately 0.9 mm, or no greater than approximately 0.5 mm of the distance from the interface with the interior layer 304.

An open porosity of the intermediate layer 604 may be no greater than approximately 99%, no greater than approximately 97%, no greater than approximately 95%, no greater than approximately 90%, or no greater than approximately 80% of an open porosity of the exterior layer 104. In an embodiment, the intermediate layer 604 has an open porosity of at least approximately 4%, at least approximately 8%, at least approximately 11%, or at least approximately 15%, and in another embodiment, has an open porosity no greater than approximately 28%, no greater than approximately 21%, no greater than approximately 17%, or no greater than approximately 13%. In a further embodiment, the intermediate layer 604 has an open porosity of at least approximately 4%, at least approximately 7%, at least approximately 10%, or at least approximately 14%, and in another embodiment, has an open porosity no greater than approximately 28%, no greater than approximately 20%, no greater than approximately 16%, or no greater than approximately 12%.

A volume occupied by the exterior layer 104 before the reaction is substantially the same as the volume occupied by a combination of the unreacted portion of exterior layer 104 and the intermediate layer 604. In actual practice, the volume may change such that the volume after the reaction is greater than or less than the volume before the reaction. In an embodiment, the volume of the combination of the unreacted portion of the exterior layer 104 and the intermediate layer 604 is within approximately 30%, within approximately 20%, within approximately 15%, within approximately 9%, within approximately 5%, or within approximately 2% of the volume of the exterior layer 104 before the reaction.

The intermediate layer 604 can include a particular metal carbonate, wherein the particular metal of the metal carbonate originates from the exterior layer 104. In another embodiment, the intermediate layer 604 can include a compound with a metal element from the interior layer 204 and a different metal element from the exterior layer 104.

The exterior layer 104 may include an antimicrobial agent as originally formed, or the reaction with the interior layer 204, the exterior layer 104, or both can produce an antimicrobial agent. In a particular embodiment, the antimicrobial agent comprises a photocatalytic antimicrobial agent adjacent to a surface of the exterior layer 104 that is opposite another surface of the exterior layer 104 that lies closer to the interior layer 204. In a further embodiment, the reaction produces $Cu_2O$, $Ag_2O$, $SnO_2$, ZnO, $TiO_2$, or any combination thereof.

Figure 7:
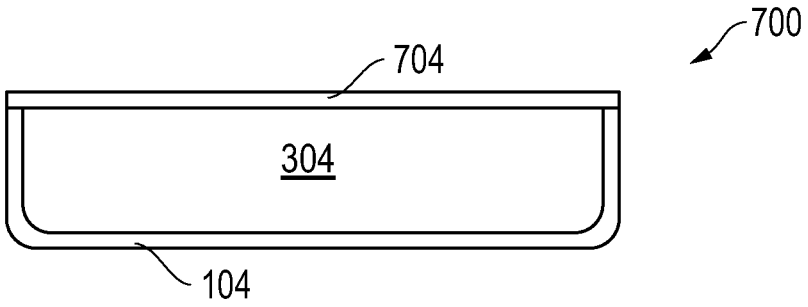
FIG. 7 includes an illustration of a cross-sectional view of a substantially completed building product in accordance with still a further embodiment.

In a further embodiment, a layer 704 can be placed on the interior layer 304, the exterior layer 104, or a combination thereof to produce the building product 700, as illustrated in FIG. 7. The layer 704 may be an adhesive layer that can be used in attaching the building product 700 to a building structure. In another embodiment, the layer 704 may be a protective layer to prevent scratches or damage during shipping or installation, or an adverse interaction between the building product 700 and the building structure. For example, the layer 704 can include a dielectric layer that may prevent a voltaic cell from being formed between the building structure and the interior layer 304, the exterior layer 104, or both the interior layer 304 and the exterior layer 104.

The building products as described herein can be useful in a variety of different applications. The building product can include a roofing product, a countertop, a ceramic tile, cladding for a building structure, or the like. In a particular embodiment, the cladding can include wall cladding, floor cladding, or ceiling cladding. In a further embodiment, the cladding includes a bathroom panel or tile or a shower stall panel or tile. In still another embodiment, the cladding includes exterior siding configured to be attached to an exterior of a building structure and exposed to an outdoor environment.

Figure 8:
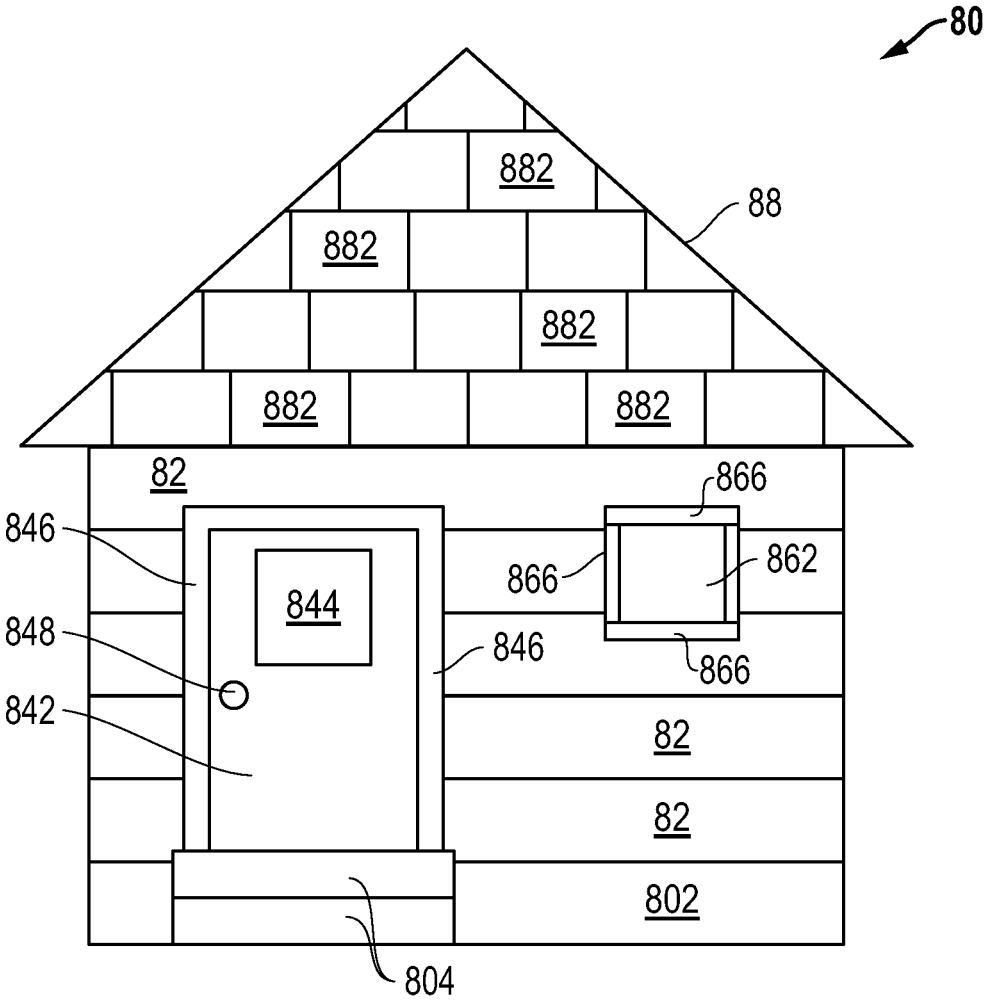
FIG. 8 includes an illustration of a cross-sectional view of a building that includes one or more building products in accordance with any of the embodiments described herein.

FIG. 8 includes an illustration of a side view of a structure 80 that includes different building materials. In the illustrated embodiment, the structure 80 includes a house or another habitat. Another structure can include a building, such as an office building, an outdoor structure for a pet, an outdoor structure that is exposed to the outdoors. The structure 80 includes a foundation 802 and stairs 804. The structure 80 has walls that include siding 82. In another embodiment (not illustrated), masonry or another material may present along the along an exposed surface along the walls of the structure 80. The structure 80 further includes a door having a main body 842, a window 844, and a door knob 848. Door frame 846 lies adjacent to sides of the door. The structure 80 still further includes a window 862 that is surrounding by window frame 866. The window 844 or 862 can include substantially transparent or translucent glass, such as glass blocks commonly used to allow visible light to pass yet provide privacy to the occupants of the structure 80.

The structure 80 includes a roof 88 that is covered by roofing articles, such as roofing tiles 882. Any of the siding 82, the door 842, and door frame 846, the window frame 866 or the roofing tiles 882 can include any of the building products as previously described.

The formation of building products as described herein can help reduce atmospheric $CO_2$ or another greenhouse gas by capturing such gas to form carbonic acid or a carbonate compound. The carbonic acid or carbonate compound can react with a metal to form a stable metal carbonate that is not readily converted back to $CO_2$ in normal use of the building product. Thus, the process can be used to reduce $CO_2$ in the atmosphere and still form a useful the building product. Additional benefits can include using a less expensive or less visibly appealing material for an interior layer and convert it to a compound that is more weather resistant, durable, have another desirable property, or any combination thereof. The installation of the building products may not change or may be only slightly modified.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Item 1. A building product can include:

a first layer having a first material; and a second layer having a second material and a third material that includes a metal carbonate, wherein:

the first material is different from the second material; and the second and third materials include the same metal element.

Item 2. The building product of Item 1, wherein the first material has a smaller average diameter as compared to the second material.

Item 3. The building product of Item 1, wherein the first material has a first average diameter, the second material has a second average diameter, and the first average diameter is no greater than approximately 95%, no greater than approximately 90%, no greater than approximately 80%, no greater than approximately 70%, no greater than approximately 50%, or no greater than approximately 20% of the second average diameter.

Item 4. The building product of Item 1, wherein the second material has a D10 average diameter of at least approximately 0.001 microns, at least approximately 0.015 microns, at least approximately 0.11 microns, or at least approximately 1 micron.

Item 5. The building product of Item 1, wherein the second material has a D10 average diameter no greater than approximately 300 microns, no greater than approximately 9 microns, no greater than approximately 0.7 microns, or no greater than approximately 0.01 microns.

Item 6. The building product of Item 1, wherein the second material has a D50 average diameter of at least approximately 0.1 microns, at least approximately 0.7 microns, at least approximately 3 microns, or at least approximately 10 microns.

Item 7. The building product of Item 1, wherein the second material has a D50 average diameter no greater than approximately 500 microns, no greater than approximately 60 microns, no greater than approximately 11 microns, or no greater than approximately 5 microns.

Item 8. The building product of Item 1, wherein the second material has a D90 average diameter of at least approximately 1 micron, at least approximately 9 microns, at least approximately 21 microns, or at least approximately 50 microns.

Item 9. The building product of Item 1, wherein the second material has a D90 average diameter no greater than approximately 700 microns, no greater than approximately 300 microns, no greater than approximately 125 microns, or no greater than approximately 50 microns.

Item 10. The building product of Item 1, wherein the first material has a D10 average diameter of at least approximately 0.001 microns, at least approximately 0.003 microns, at least approximately 0.007 microns, or at least approximately 0.01 microns.

Item 11. The building product of Item 1, wherein the first material has a D10 average diameter no greater than approximately 30 microns, no greater than approximately 8 microns, no greater than approximately 0.2 microns, or no greater than approximately 0.01 microns.

Item 12. The building product of Item 1, wherein the first material has a D50 average diameter of at least approximately 0.1 microns, at least approximately 0.8 microns, at least approximately 1.3 microns, or at least approximately 2 microns.

Item 13. The building product of Item 1, wherein the first material has a D50 average diameter no greater than approximately 200 microns, no greater than approximately 21 microns, no greater than approximately 7 microns, or no greater than approximately 0.7 microns.

Item 14. The building product of Item 1, wherein the first material has a D90 average diameter of at least approximately 1 micron, at least approximately 8 microns, at least approximately 19 microns, or at least approximately 30 microns.

Item 15. The building product of Item 1, wherein the first material has a D90 average diameter no greater than approximately 500 microns, no greater than approximately 220 microns, no greater than approximately 110 microns, or no greater than approximately 30 microns.

Item 16. The building product of Item 1, wherein the first layer has a smaller amount of open porosity as compared to the second layer.

Item 17. The building product of Item 1, wherein the first layer has a first open porosity, the second layer has a second open porosity, and the first open porosity is no greater than approximately 95%, no greater than approximately 90%, no greater than approximately 80%, no greater than approximately 70%, no greater than approximately 50%, or no greater than approximately 20% of the second open porosity.

Item 18. The building product of Item 1, wherein the second layer has an open porosity of at least approximately 5%, at least approximately 12%, at least approximately 17%, or at least approximately 25%.

Item 19. The building product of Item 1, wherein the second layer has an open porosity no greater than approximately 30%, no greater than approximately 23%, no greater than approximately 19%, or no greater than approximately 15%.

Item 20. The building product of Item 1, wherein the first layer has an open porosity of at least approximately 3%, at least approximately 7%, at least approximately 10%, or at least approximately 12%.

Item 21. The building product of Item 1, wherein the first layer has an open porosity of no greater than approximately 15%, no greater than approximately 12%, no greater than approximately 10%, or no greater than approximately 8%.

Item 22. The building product of Item 1, wherein the second layer has a pore size that is at least about 0.01 microns, at least about 0.1 microns, or at least about 0.5 microns; or greater than about 100 microns, no greater than about 20 microns, or no greater than about 1 micron.

Item 23. The building product of Item 1, wherein the first layer occupies a first volume, the second layer occupies a second volume, and a ratio of the second volume to the first volume is at least approximately 1.1:1, at least approximately 1.5:1, at least approximately 2:1, at least approximately 3:1, at least approximately 5:1, or at least approximately 9:1.

Item 24. The building product of Item 1, wherein the first material has a different composition as compared to the second material.

Item 25. The building product of Item 1, wherein the first material is capable of reacting with the same metal element under conditions at which the second material can react with the same metal to form the third material.

Item 26. The building product of Item 1, wherein the second layer further includes an antimicrobial agent, wherein the second material and the antimicrobial agent include the same metal element.

Item 27. The building product of Item 1, wherein the antimicrobial agent includes a photocatalytic antimicrobial agent adjacent to a surface of the first layer that is opposite another surface of the first layer that lies closer to the second layer.

Item 28. The building product of Item 27, wherein the antimicrobial agent includes $Cu_2O$, $Ag_2O$, $SnO_2$, ZnO, $TiO_2$, or any combination thereof.

Item 29. The building product of Item 1, further including an interphase compound between the first layer and the second layer, wherein the interphase compound includes a first constituent from the first material and a second constituent from the second material.

Item 30. The building product of Item 1, wherein the first layer further includes a particular metal carbonate, wherein the first material and the particular metal carbonate include the same metal element.

Item 31. The building product of Item 30, wherein the particular metal carbonate extends to an interface penetration distance from an interface with the first layer.

Item 32. The building product of Item 31, wherein the interface penetration distance extends partly, but not completely through the first layer.

Item 33. The building product of Item 31, wherein the interface penetration distance extends at least approximately 10%, at least approximately 20%, at least approximately 30%, at least approximately 40%, at least approximately 50%, at least approximately 60%, at least approximately 70%, at least approximately 80%, or at least approximately 90% of the distance from the interface to an outer surface of the first layer.

Item 34. The building product of Item 31, wherein the interface penetration distance extends at least approximately 0.011 mm, at least approximately 0.05 mm, at least approximately 0.11 mm, at least approximately 0.5 mm, at least approximately 1.1 mm, or at least approximately 5 mm of the distance from the interface.

Item 35. The building product of Item 31, wherein the interface penetration distance extends no greater than approximately 11 mm, no greater than approximately 7 mm, no greater than approximately 4 mm, no greater than approximately 2 mm, no greater than approximately 0.9 mm, or no greater than approximately 0.5 mm of the distance from the interface.

Item 36. The building product of Item 1, wherein the second material includes a metal oxide, a metal silicate, or a metal hydroxide.

Item 37. The building product of Item 1, wherein the second material includes a mixed-metal compound.

Item 38. The building product of Item 1, wherein the first material includes a metal oxide, a metal silicate, or a metal hydroxide.

Item 39. The building product of Item 1, wherein the first material includes a mixed-metal compound.

Item 40. The building product of Item 1, wherein the first material, the second material, or the first and second materials include a low density filler material or a void containing filler material.

Item 41. The building product of Item 1, wherein a solubility of the metal carbonate in water at 20° C. is less than about 0.05, less than about 0.004, less than about 0.001, or less than about 0.0008 grams per 100 grams of water.

Item 42. The building product of Item 1, wherein the building product includes a roofing product.

Item 43. The building product of Item 1, wherein the building product includes a countertop.

Item 44. The building product of Item 1, wherein the building product includes a ceramic tile.

Item 45. The building product of Item 1, wherein the building product includes cladding for a building structure.

Item 46. The building product of Item 45, wherein the cladding includes wall cladding, floor cladding, or ceiling cladding.

Item 47. The building product of Item 45, wherein the cladding includes a bathroom panel or tile.

Item 48. The building product of Item 45, wherein the cladding includes a shower stall panel or tile.

Item 49. The building product of Item 45, wherein the cladding includes exterior siding configured to be attached to an exterior of a building structure and exposed to an outdoor environment.

Item 50. A process of forming a building product can include:

providing a first layer having a first material;

providing a second layer having a second material that different from the first material, wherein the second layer has pores;

infiltrating a fluid into the pores of the second layer while the first layer is present and adjacent to the second layer, wherein the fluid includes a carbonate; and reacting the carbonate with a metal compound within the second layer to form a metal carbonate within the second layer.

Item 51. The process of Item 50, wherein the first material has a smaller average diameter as compared to the second material.

Item 52. The process of Item 50, wherein the first material has a first average diameter, the second material has a second average diameter, and the first average diameter is no greater than approximately 95%, no greater than approximately 90%, no greater than approximately 80%, no greater than approximately 70%, no greater than approximately 50%, or no greater than approximately 20% of the second average diameter.

Item 53. The process of Item 50, wherein the second material has a D10 average diameter of at least approximately 0.001 microns, at least approximately 0.015 microns, at least approximately 0.11 microns, or at least approximately 1 micron.

Item 54. The process of Item 50, wherein the second material has a D10 average diameter no greater than approximately 300 microns, no greater than approximately 9 microns, no greater than approximately 0.7 microns, or no greater than approximately 0.01 microns.

Item 55. The process of Item 50, wherein the second material has a D50 average diameter of at least approximately 0.1 microns, at least approximately 0.7 microns, at least approximately 3 microns, or at least approximately 10 microns.

Item 56. The process of Item 50, wherein the second material has a D50 average diameter no greater than approximately 500 microns, no greater than approximately 60 microns, no greater than approximately 11 microns, or no greater than approximately 5 microns.

Item 57. The process of Item 50, wherein the second material has a D90 average diameter of at least approximately 1 micron, at least approximately 9 microns, at least approximately 21 microns, or at least approximately 50 microns.

Item 58. The process of Item 50, wherein the second material has a D90 average diameter no greater than approximately 700 microns, no greater than approximately 300 microns, no greater than approximately 125 microns, or no greater than approximately 50 microns.

Item 59. The process of Item 50, wherein the first material has a D10 average diameter of at least approximately 0.001 microns, at least approximately 0.003 microns, at least approximately 0.007 microns, or at least approximately 0.01 microns.

Item 60. The process of Item 50, wherein the first material has a D10 average diameter no greater than approximately 30 microns, no greater than approximately 8 microns, no greater than approximately 0.2 microns, or no greater than approximately 0.01 microns.

Item 61. The process of Item 50, wherein the first material has a D50 average diameter of at least approximately 0.1 microns, at least approximately 0.8 microns, at least approximately 1.3 microns, or at least approximately 2 microns.

Item 62. The process of Item 50, wherein the first material has a D50 average diameter no greater than approximately 200 microns, no greater than approximately 21 microns, no greater than approximately 7 microns, or no greater than approximately 0.7 microns.

Item 63. The process of Item 50, wherein the first material has a D90 average diameter of at least approximately 1 micron, at least approximately 8 microns, at least approximately 19 microns, or at least approximately 30 microns.

Item 64. The process of Item 50, wherein the first material has a D90 average diameter no greater than approximately 500 microns, no greater than approximately 220 microns, no greater than approximately 110 microns, or no greater than approximately 30 microns.

Item 65. The process of Item 50, wherein the first layer has a smaller amount of open porosity as compared to the second layer.

Item 66. The process of Item 50, wherein before reacting, the first layer has a first open porosity, the second layer has a second open porosity, and the first open porosity is no greater than approximately 95%, no greater than approximately 90%, no greater than approximately 80%, no greater than approximately 70%, no greater than approximately 50%, or no greater than approximately 20% of the second open porosity.

Item 67. The process of Item 50, wherein after reacting, the first layer has a first open porosity, the second layer has a second open porosity, and the first open porosity is at least approximately 11%, at least approximately 20%, at least approximately 30%, at least approximately 50%, or at least approximately 70% of the second open porosity.

Item 68. The process of Item 50, wherein the second layer has a pre-reaction open porosity before reacting, the second layer has a post-reaction open porosity after reacting, and the post-reaction open porosity is no greater than approximately 99%, no greater than approximately 95%, no greater than approximately 90%, no greater than approximately 80%, or no greater than approximately 70% of the pre-reaction open porosity.

Item 69. The process of Item 50, wherein before reacting, the second layer has an open porosity of at least approximately 5%, at least approximately 12%, at least approximately 17%, or at least approximately 25%.

Item 70. The process of Item 50, wherein before reacting, the second layer has an open porosity no greater than approximately 30%, no greater than approximately 23%, no greater than approximately 19%, or no greater than approximately 15%.

Item 71. The process of Item 50, wherein after reacting, the second layer has an open porosity of at least approximately 4%, at least approximately 11%, at least approximately 15%, or at least approximately 18%.

Item 72. The process of Item 50, wherein after reacting, the second layer has an open porosity no greater than approximately 29%, no greater than approximately 22%, no greater than approximately 18%, or no greater than approximately 15%.

Item 73. The process of Item 50, wherein before reacting, the second material has a pore size that is at least about 0.01 microns, at least approximately 0.1 microns, or at least approximately 0.5 microns; or no greater than approximately 100 microns, no greater than approximately 20 microns, or no greater than approximately 1 micron.

Item 74. The process of Item 50, wherein a solubility of the metal carbonate in water at 20° C. is less than about 0.05, less than about 0.004, less than about 0.001, or less than about 0.0008 grams per 100 grams of water.

Item 75. The process of Item 50, wherein the first material has a different composition as compared to the second material.

Item 76. The process of Item 50, wherein providing the first layer and providing the second layer includes:

partly filling a first portion of a mould with the first material; and filling a second portion of the mould with the second material after partly filling the first portion.

Item 77. The process of Item 76, wherein providing the second layer further includes compressing the second material within the mould.

Item 78. The process of Item 77, wherein compressing is performed using vibratory compaction.

Item 79. The process of Item 50, wherein providing the first layer includes extruding the first layer onto the second layer before infiltrating the second layer.

Item 80. The process of Item 50, wherein the first layer occupies a first volume, the second layer occupies a second volume, and a ratio of the second volume to the first volume is at least approximately 1.1:1, at least approximately 1.5:1, at least approximately 2:1, at least approximately 3:1, at least approximately 5:1, or at least approximately 9:1.

Item 81. The process of Item 50, wherein before reacting, the building product occupies a pre-reaction volume, after reacting, the building product occupies a post reaction volume, and the post-reaction volume is within approximately 30%, within approximately 20%, within approximately 15%, within approximately 9%, within approximately 5%, or within approximately 2% of the pre-reaction volume.

Item 82. The process of Item 50, wherein before reacting, the second layer occupies a pre-reaction volume, after reacting, the second layer occupies a post reaction volume, and the post-reaction volume is within approximately 30%, approximately 20%, within approximately 15%, within approximately 9%, within approximately 5%, or within approximately 2% of the pre-reaction volume.

Item 83. The process of Item 50, wherein the fluid includes a liquid.

Item 84. The process of Item 83, wherein liquid includes water.

Item 85. The process of Item 83, wherein liquid has substantially no water.

Item 86. The process of Item 83, wherein liquid includes ammonia or an organic compound.

Item 87. The process of Item 83, wherein the liquid has a pH greater than 7, 8, 9, 10, 11, or 12.

Item 88. The process of Item 83, wherein the liquid has a pH less than 7, 6, 5, or 4.

Item 89. The process of Item 83, wherein reacting is performed at a pressure higher than atmospheric pressure.

Item 90. The process of Item 83, wherein reacting is performed at a pressure of at least approximately 5 kPa, at least approximately 11 kPa, at least approximately 50 kPa, at least approximately 110 kPa, at least approximately 500 kPa, at least approximately 1.1 MPa, at least approximately 5 MPa, at least approximately 11 MPa, or at least approximately 50 MPa.

Item 91. The process of Item 83, wherein reacting is performed at a pressure no greater than approximately 900 MPa, no greater than approximately 500 MPa, no greater than least approximately 90 MPa, or no greater than approximately 50 MPa, no greater than approximately 900 kPa, no greater than approximately 500 kPa, no greater than approximately 90 kPa, or no greater than approximately 50 kPa.

Item 92. The process of Item 83, wherein reacting is performed at a temperature of at least approximately 20° C., at least approximately 50° C., at least approximately 80° C., at least approximately 110° C., at least approximately 150° C., at least approximately 200° C., at least approximately 250° C., or at least approximately 300° C.

Item 93. The process of Item 83, wherein reacting is performed at a temperature no greater than approximately 1000° C., no greater than approximately 500° C., no greater than approximately 300° C., no greater than approximately 250° C., no greater than approximately 190° C., no greater than approximately 150° C., no greater than approximately 130° C., no greater than approximately 100° C., or no greater than approximately 90° C.

Item 94. The process of Item 83, wherein reacting is performed for a time period of at least approximately 11 seconds, at least approximately 1.1 minutes, at least approximately 5 minutes, at least approximately 11 minutes, at least approximately 20 minutes, at least approximately 1 hour, at least approximately 11 hours, at least approximately 20 hours, at least approximately 50 hours.

Item 95. The process of Item 83, wherein reacting is performed for a time period no greater than approximately 200 hours, no greater than approximately 90 hours, no greater than approximately 24 hours, no greater than approximately 5 hours, no greater than approximately 3 hours, no greater than approximately 2 hours, no greater than approximately 0.9 hour, or no greater than approximately 0.5 hour.

Item 96. The process of Item 50, wherein reacting further produces an antimicrobial agent.

Item 97. The process of Item 50, wherein the antimicrobial agent includes a photocatalytic antimicrobial agent adjacent to a surface of the first layer that is opposite another surface of the first layer that lies closer to the second layer.

Item 98. The process of Item 50, wherein reacting further produces $Cu_2O$, $Ag_2O$, $SnO_2$, ZnO, $TiO_2$, or any combination thereof.

Item 99. The process of Item 50, wherein reacting is performed such that an interphase compound is formed that includes a first constituent from the first material and a second constituent from the second material.

Item 100. The process of Item 50, wherein:

infiltrating the fluid includes infiltrating the fluid such that the fluid reaches the first layer; and reacting the carbonate includes reacting the carbonate with a particular metal compound within the first layer to form a particular metal carbonate.

Item 101. The process of Item 100, wherein the particular metal carbonate extends to an interface penetration distance from an interface with the first layer.

Item 102. The process of Item 101, wherein the interface penetration distance extends partly, but not completely through the first layer.

Item 103. The process of Item 101, wherein the interface penetration distance extends at least approximately 10%, at least approximately 20%, at least approximately 30%, at least approximately 40%, at least approximately 50%, at least approximately 60%, at least approximately 70%, at least approximately 80%, or at least approximately 90% of the distance from the interface to an outer surface of the first layer.

Item 104. The process of Item 101, wherein the interface penetration distance extends at least approximately 0.011 mm, at least approximately 0.05 mm, at least approximately 0.11 mm, at least approximately 0.5 mm, at least approximately 1.1 mm, or at least approximately 5 mm of the distance from the interface.

Item 105. The process of Item 101, wherein the interface penetration distance extends no greater than approximately 11 mm, no greater than approximately 7 mm, no greater than approximately 4 mm, no greater than approximately 2 mm, no greater than approximately 0.9 mm, or no greater than approximately 0.5 mm of the distance from the interface.

Item 106. The process of Item 100, wherein the first layer has a pre-reaction open porosity before reacting, the first layer has a post-reaction open porosity after reacting, and the post-reaction open porosity is no greater than approximately 99%, no greater than approximately 97%, no greater than approximately 95%, no greater than approximately 90%, or no greater than approximately 80% of the pre-reaction open porosity.

Item 107. The process of Item 100, wherein before reacting, the first layer has an open porosity of at least approximately 3%, at least approximately 7%, at least approximately 10%, or at least approximately 12%.

Item 108. The process of Item 100, wherein before reacting, the first layer has an open porosity no greater than approximately 15%, no greater than approximately 12%, no greater than approximately 10%, or no greater than approximately 8%.

Item 109. The process of Item 100, wherein after reacting, the first layer has an open porosity of at least approximately 4%, at least approximately 7%, at least approximately 10%, or at least approximately 14%.

Item 110. The process of Item 100, wherein after reacting, the first layer has an open porosity no greater than approximately 28%, no greater than approximately 20%, no greater than approximately 16%, or no greater than approximately 12%.

Item 111. The process of Item 50, wherein before reacting, the first layer occupies a pre-reaction volume, after reacting, the first layer occupies a post reaction volume, and the post-reaction volume is within approximately 30%, approximately 20%, no greater than approximately 15%, no greater than approximately 9%, no greater than approximately 5%, or no greater than approximately 2% of the pre-reaction volume.

Item 112. The process of Item 50, wherein the second material includes a metal oxide, a metal silicate, or a metal hydroxide.

Item 113. The process of Item 50, wherein the second material includes a mixed-metal compound.

Item 114. The process of Item 50, wherein the first material, the second material, or the first and second materials include a low density filler material or a void containing filler material.

Item 115. The process of Item 50, wherein the first material includes a metal oxide, a metal silicate, or a metal hydroxide.

Item 116. The process of Item 50, wherein the first material includes a mixed-metal compound.

Item 117. The process of Item 50, wherein the building product includes a roofing product.

Item 118. The process of Item 50, wherein the building product includes a countertop.

Item 119. The process of Item 50, wherein the building product includes a ceramic tile.

Item 120. The process of Item 50, wherein the building product includes cladding for a building structure.

Item 121. The process of Item 120, wherein the cladding includes wall cladding, floor cladding, or ceiling cladding.

Item 122. The process of Item 120, wherein the cladding includes a bathroom panel or tile.

Item 123. The process of Item 120, wherein the cladding includes a shower stall panel or tile.

Item 124. The process of Item 120, wherein the cladding includes exterior siding configured to be attached to an exterior of a building structure and exposed to an outdoor environment.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A building product comprising:

a first layer having a first material;

a second layer having a second material and a third material; and an outer surface, wherein:

the first material is different from the second material;

an inner surface of the first layer contacts the second material and the third material, and an outer surface of the first layer defines a majority of the outer surface of the building product;

the second material comprises a metal element;

the third material forms a portion of the outer surface and comprises a metal carbonate including the metal element.

2. The building product of claim 1, wherein the first material has a smaller average diameter as compared to the second material.

3. The building product of claim 1, wherein the second material has a D10 average diameter of at least approximately 0.001 microns.

4. The building product of claim 1, wherein the first material has a D10 average diameter of at least approximately 0.001 microns.

5. The building product of claim 1, wherein the first layer has a smaller amount of open porosity as compared to the second layer.

6. The building product of claim 1, wherein the first layer occupies a first volume, the second layer occupies a second volume, and a ratio of the second volume to the first volume is at least approximately 1.1:1.

7. A building product comprising:

an exterior layer comprising a first material;

an intermediate layer comprising a second material; and an interior layer comprising a third material, wherein:

the intermediate layer is disposed between the exterior and interior layers;

the first material comprises a first metal element;

the second material comprises a carbonate including the first metal element;

the third material comprises a carbonate including a second metal element different than the first metal element; and each of the first, second, and third materials define a portion of an outer surface of the building product.

8. The building product of claim 1, further comprising an antimicrobial agent comprising a photocatalytic antimicrobial agent adjacent to a surface of the first layer that is opposite another surface of the first layer that lies closer to the second layer.

9. The building product of claim 1, wherein the first layer further comprises a particular metal carbonate, wherein the first material and the particular metal carbonate comprise a same metal element.

10. The building product of claim 1, wherein the second material and the third material form discrete sublayers within the second layer.

11. The building product of claim 1, wherein the first material, the second material, or the first and second materials include a low density filler material or a void containing filler material.

12. The building product of claim 1, wherein a solubility of the metal carbonate in water at 20° C. is less than about 0.05 grams per 100 grams of water.

13. The building product of claim 1, wherein the building product comprises a roofing product.

14. The building product of claim 1, wherein the building product comprises cladding for a building structure.

15. A process of forming the building product of claim 1 comprising:

providing a first layer having a first material;

providing a second layer having a second material that different from the first material, wherein the second layer has pores;

infiltrating a fluid into the pores of the second layer while the first layer is present and adjacent to the second layer, wherein the fluid includes a carbonate; and reacting the carbonate with a metal compound within the second layer to form a metal carbonate within the second layer, wherein the building product has an exterior surface defined by a portion of the first layer and a portion of the second layer.

16. The process of claim 15, wherein a solubility of the metal carbonate in water at 20° C. is less than about 0.05 grams per 100 grams of water.

17. The process of claim 15, wherein providing the first layer and providing the second layer comprises:

partly filling a first portion of a mould with the first material; and filling a second portion of the mould with the second material after partly filling the first portion.

18. The process of claim 15, wherein providing the first layer comprises extruding the first layer onto the second layer before infiltrating the second layer.

19. The process of claim 15, wherein the first layer occupies a first volume, the second layer occupies a second volume, and a ratio of the second volume to the first volume is at least approximately 1.1:1.

20. The process of claim 15, wherein the fluid comprises a liquid.

21. The process of claim 15, wherein the building product further comprises an antimicrobial agent comprising a photocatalytic antimicrobial agent adjacent to a surface of the first layer that is opposite another surface of the first layer that lies closer to the second layer.

22. The process of claim 15, wherein the building product comprises a roofing product.

23. The process of claim 15, wherein the building product comprises cladding for a building structure.

* * * * *